US010472847B2

(12) United States Patent
Wiles et al.

(10) Patent No.: US 10,472,847 B2
(45) Date of Patent: Nov. 12, 2019

(54) CROSS ARM SUPPORT STRUCTURE

(71) Applicant: Valmont Industries, Inc., Omaha, NE (US)

(72) Inventors: James Robert Wiles, Graham, TX (US); Robert Paulin, Irmo, SC (US); Scott Clevenger, Newberry, SC (US)

(73) Assignee: Valmont Industries, Inc., Omaha, NE (US)

( * ) Notice: Subject to any disclaimer, the term of this patent is extended or adjusted under 35 U.S.C. 154(b) by 0 days.

(21) Appl. No.: 15/862,345

(22) Filed: Jan. 4, 2018

(65) Prior Publication Data

US 2018/0195306 A1 Jul. 12, 2018

Related U.S. Application Data

(60) Provisional application No. 62/443,196, filed on Jan. 6, 2017.

(51) Int. Cl.

| | |
|---|---|
| ***E04H 12/24*** | (2006.01) |
| ***E04C 3/29*** | (2006.01) |
| ***E04C 3/06*** | (2006.01) |
| *E04C 3/04* | (2006.01) |

(52) U.S. Cl.

CPC ..... *E04H 12/24* (2013.01); *E04C 3/06* (2013.01); *E04C 3/29* (2013.01); *E04C 2003/043* (2013.01); *E04C 2003/0417* (2013.01); *E04C 2003/0465* (2013.01)

(58) Field of Classification Search

CPC ..... E04H 12/24; E04C 3/29; E04C 3/06

USPC ..... 52/660–669, 844; 248/72, 74.2

See application file for complete search history.

(56) References Cited

U.S. PATENT DOCUMENTS

| | | | | | |
|---|---|---|---|---|---|
| 312,349 | A | * | 2/1885 | Griffin | E04C 3/34 52/834 |
| 1,090,171 | A | * | 3/1914 | Schisler | 138/115 |
| 3,546,844 | A | * | 12/1970 | Schwartz | E04B 9/345 52/509 |
| 3,600,792 | A | * | 8/1971 | Valluy | F16L 3/22 165/172 |
| 4,705,244 | A | * | 11/1987 | Saotome | F16L 3/223 248/222.51 |
| 5,644,106 | A | * | 7/1997 | Gajeski | H01C 1/01 174/138 G |
| 5,653,411 | A | * | 8/1997 | Picco | F16L 3/2235 248/74.1 |
| 5,704,188 | A | * | 1/1998 | Coulis | E04C 3/36 248/156 |

(Continued)

FOREIGN PATENT DOCUMENTS

| | | | |
|---|---|---|---|
| AU | 2003228653 | A1 | 11/2003 |
| CA | 2481553 | A1 | 10/2003 |

(Continued)

*Primary Examiner* — Brian E Glessner
*Assistant Examiner* — Adam G Barlow
(74) *Attorney, Agent, or Firm* — Milligan PC LLO

(57) ABSTRACT

The present invention provides an improved cross arm structure which supports various elements such as pin insulators and keeps the supported elements from crushing the arm when connectors and pins are tightened. According to a preferred embodiment, the present invention includes a cross arm with an inserted geometric structure which extends between the outer walls of the cross arm structure.

10 Claims, 11 Drawing Sheets

(56) References Cited

U.S. PATENT DOCUMENTS

| | | | | |
|---|---|---|---|---|
| 6,123,485 | A * | 9/2000 | Mirmiran | E02D 31/02 405/232 |
| 6,155,017 | A | 12/2000 | Turner | |
| 6,453,635 | B1 | 9/2002 | Turner | |
| 6,672,026 | B2 | 1/2004 | Sumerak | |
| 7,036,775 | B2 * | 5/2006 | Nakanishi | F16L 3/223 248/68.1 |
| 7,228,672 | B2 | 6/2007 | Hayes et al. | |
| 7,398,627 | B2 * | 7/2008 | Yamamoto | E04B 2/7424 52/204.61 |
| 7,942,371 | B1 * | 5/2011 | McCoy | H02G 9/02 248/68.1 |
| 8,307,602 | B2 * | 11/2012 | Cochran, Jr. | E06B 7/08 160/104 |
| 2006/0218872 | A1 * | 10/2006 | Bigott | E04C 2/423 52/660 |
| 2010/0050568 | A1 * | 3/2010 | Griffiths | E04F 13/0733 52/834 |
| 2011/0271623 | A1 * | 11/2011 | Kurath-Grollmann | B28B 13/021 52/309.1 |
| 2015/0300531 | A1 * | 10/2015 | Schmidt | F16L 3/1041 248/74.2 |
| 2015/0377387 | A1 * | 12/2015 | Meyers | B29C 45/0017 248/74.2 |

FOREIGN PATENT DOCUMENTS

| | | | |
|---|---|---|---|
| EP | 1497508 | B1 | 11/2011 |
| KR | 100684816 | B1 | 2/2007 |
| WO | 2000004251 | A1 | 1/2000 |
| WO | 2001090504 | A1 | 11/2001 |
| WO | 2003089732 | A1 | 10/2003 |
| WO | 2003093600 | A1 | 11/2003 |

* cited by examiner

CROSS ARM SUPPORT STRUCTURE

CROSS REFERENCE TO RELATED APPLICATIONS

This patent application claims priority to U.S. Provisional Application No. 62/443,196, filed on Jan. 6, 2017, which is entirely incorporated herein by reference.

BACKGROUND OF THE DISCLOSURE

1. Field of the Disclosure

The present invention is related in general to an improved utility pole structure, and in particular to an improved cross arm structure which supports various elements such as pin insulators and keeps the supported elements from crushing the arm when connectors and pins are tightened.

2. Description of the Related Art

Structures for overhead lines take a variety of shapes depending on the type of line. Structures may be as simple as wood poles directly set in the earth, carrying one or more cross arm beams to support conductors, or "armless" construction with conductors supported on insulators attached to the side of the pole. Tubular steel poles are typically used in urban areas.

With reference to FIG. 1A, a conventional utility pole 10 of the prior art is illustrated in U.S. Pat. No. 5,505,036 (which is hereby incorporated by reference in its entirety). As shown, utility pole 10 is connected to a composite cross arm 12 which in turn supports transmission lines 13 which are attached to the cross arm 12 via an eyelet 14.

With reference to FIG. 1B, a further example is shown in which cross arms 2 and 4 are attached to a main pole 5. As further shown in FIG. 1B, cross arms 2 and 4 support a set of wires 6 via a set of pin insulators 7.

In both the examples of FIGS. 1A and 1B, because the cross arms extend away from the main body of the utility pole, they are required to be light. At the same time, the cross arms are also required to be strong and durable as they support the weight of the tension wires. Further, the cross arms must also be able to withstand attachment to the main pole. These constraints cause particular issues for cross arms formed of composite materials which are preferred because they are light weight, but which cannot always withstand the amounts of pressure needed to be connected to the main utility pole. Often this can result in bolts crushing the composite of the cross arm and causing failure or fatigue.

To solve this problem, cross arms can be attached to the utility pole using a fiberglass cover sock. However, this can also cause a problem in that the pin insulators are also covered by the sock and the pin insulators can dig into and crush the cross arm.

Based on the foregoing there is a strong need for an improved cross arm structure which supports various elements such as pin insulators and keeps the supported elements from crushing the arm when connectors and pins are tightened, and a load is applied to a pin insulator. The present invention overcomes prior art shortcomings by accomplishing these critical objectives.

SUMMARY OF THE DISCLOSURE

To minimize the limitations found in the prior art, and to minimize other limitations that will be apparent upon the reading of the specification, the preferred embodiment of the present invention provides an improved cross arm structure which supports various elements such as pin insulators and keeps the supported elements from crushing the arm when connectors and pins are tightened. According to a preferred embodiment, the present invention includes a cross arm with an inserted geometric structure which extends between the outer walls of the cross arm structure.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1A:
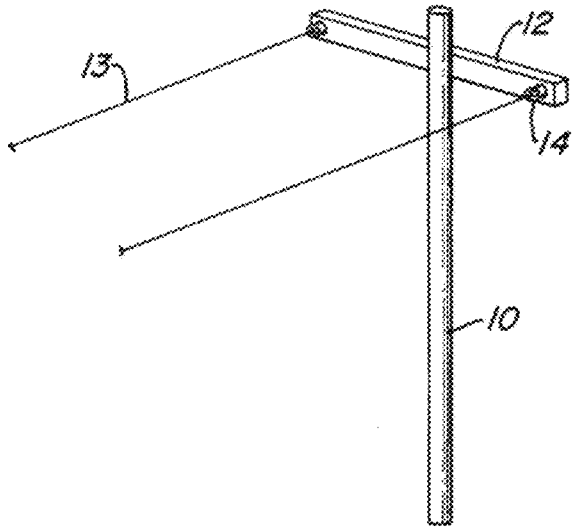
FIG. 1A is a perspective view of a utility pole and cross arm arrangement of the prior art.
Figure 1B:
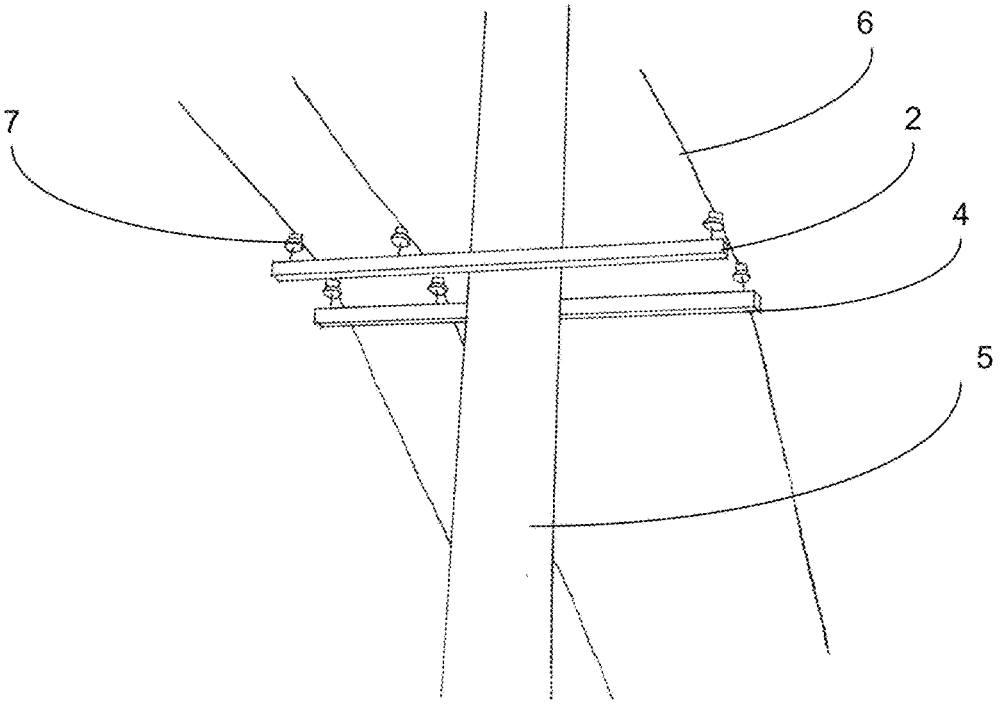
FIG. 1B is a perspective view of a further utility pole and cross arm arrangement of the prior art.
Figure 2:
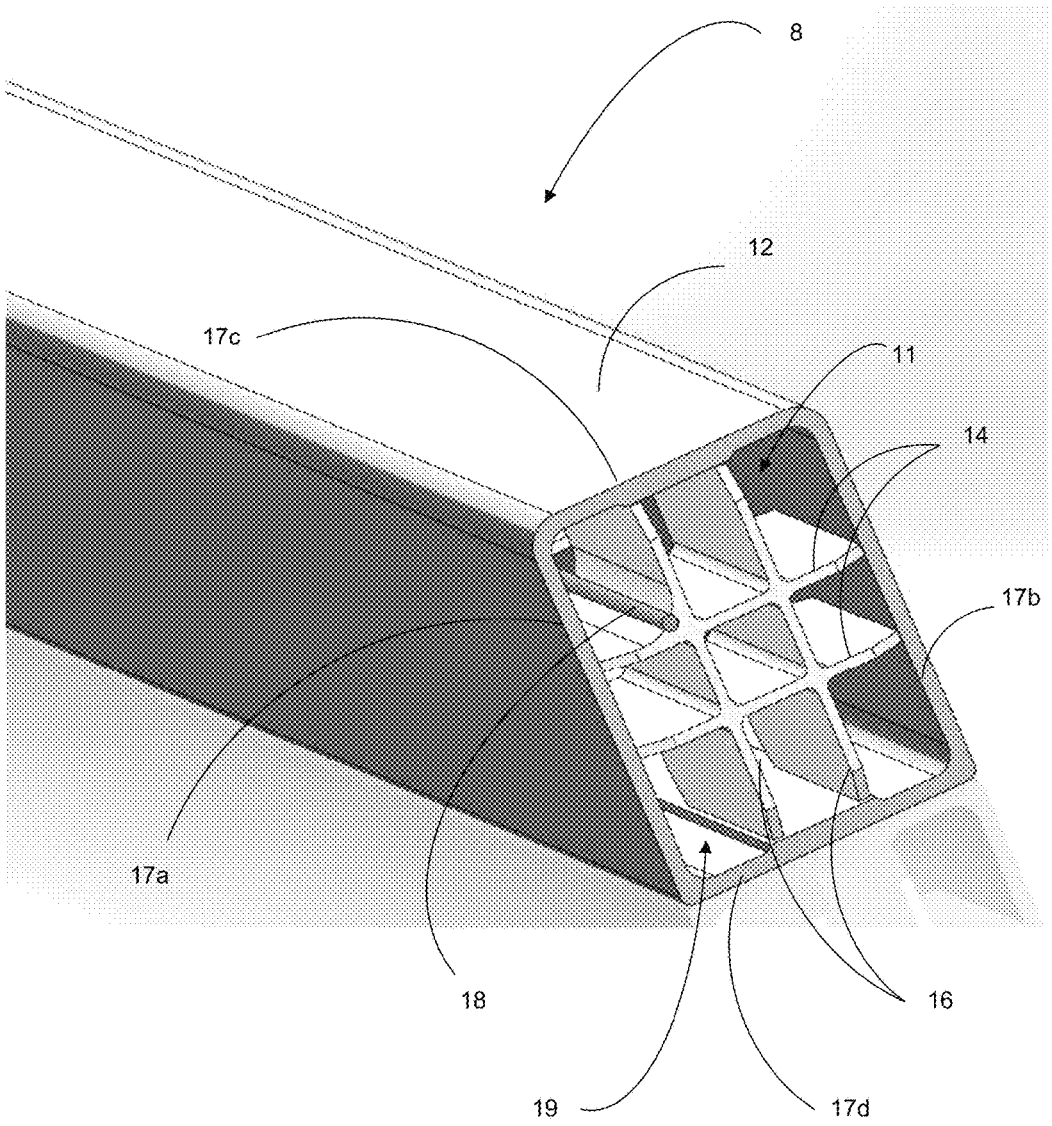
FIG. 2 is first perspective view illustrating a first preferred embodiment of the present invention.

With reference now to FIG. 2, a first perspective view illustrating a first preferred embodiment of the present invention shall now be discussed. As shown in FIG. 2, in a first preferred embodiment of the present invention, the cross arm 8 of the present invention preferably is constructed of an outer wall 12 which extends around a central core area 11. As shown, the outer wall 12 preferably includes a first side wall 17*a*, a second side wall 17*b*, a front wall 17*c* and a rear wall 17*d*. According to a further aspect of the present invention, the central core area 11 is preferably supported by an internal geometric structure 19 which extends between the first side wall 17*a* and the second side wall 17*b*, as well as between the front wall 17*c* and a rear wall 17*d*.

As shown, the exemplary inserted structure 19 preferably includes a first pair of horizontally extending walls 14 which extend between the first side wall 17*a* and the second side wall 17*b*. As further shown, the exemplary structure 19 preferably further includes a second pair of vertically extending walls 16 which intersect with horizontally extending walls 14 and which extend between the front wall 17*c* and the rear wall 17*d*. As still further shown, the inserted structure 19 may preferably further include a reinforcing pipe 18 which preferably aligns and supports the inserted structure 19 within the cross arm 8 of the present invention. Preferably, the inserted structure 19 preferably further includes an alignment hole (shown in FIG. 4 as 49) for supporting and positioning the reinforcing pipe 18.

Figure 3:
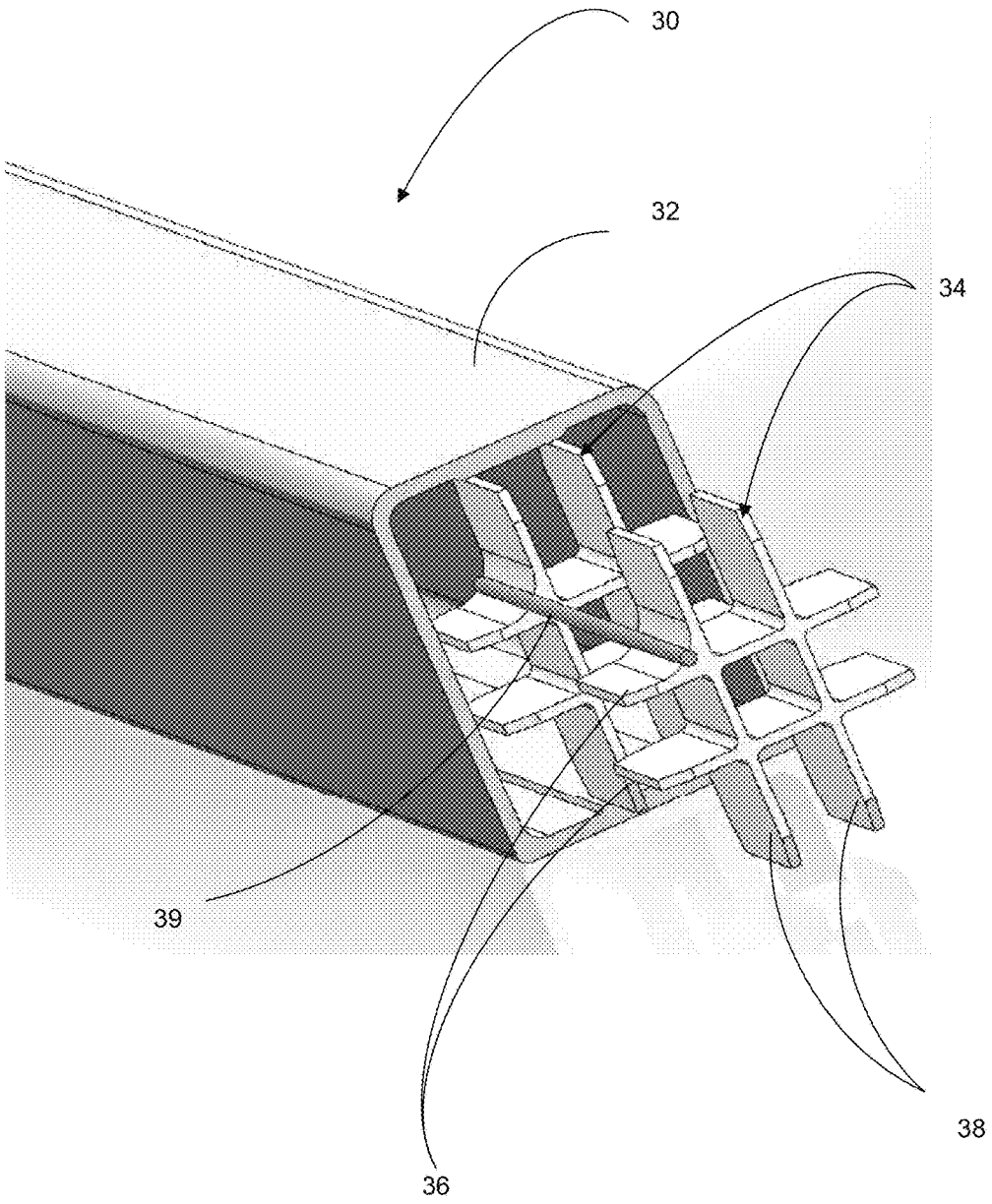
FIG. 3 is second perspective view illustrating a first preferred embodiment of the present invention.

Referring now to FIG. 3, a further aspect of the present invention shall now be further discussed. As shown in FIG. 3, an exemplary cross arm 30 with outer wall 32 is shown with multiple structural inserts 34 each formed with a pair of horizontally extending walls 36 intersecting with vertically extending walls 38. As further shown, a reinforcing pipe 39 is provided which attaches to each insert 34.

Figure 4:
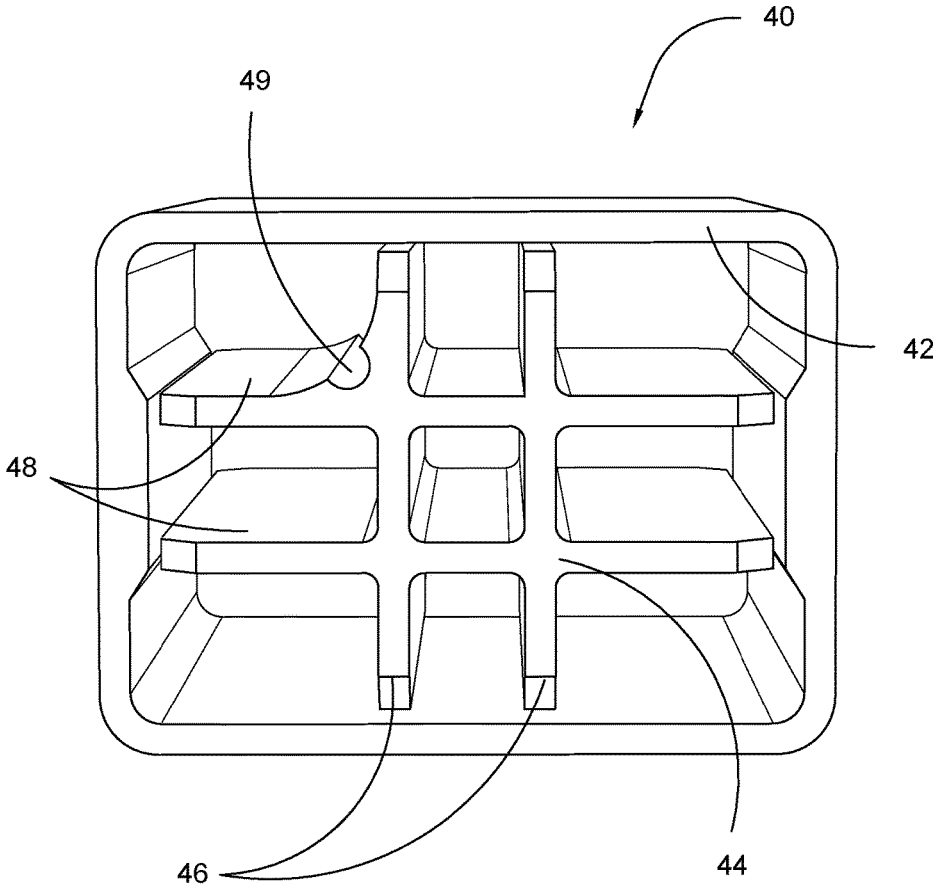
FIG. 4 is a side view of a first preferred embodiment of the present invention.

With reference now to FIG. 4, a side view of an exemplary cross arm 40 built in accordance with the present invention shall now be further discussed. As shown in FIG. 4, the exemplary cross arm 40 includes an outer wall 42 surrounding an inserted structure 44 which includes a pair of vertical walls 46 which intersect with horizontal walls 48. As further shown, the inserted structure 44 preferably further includes an alignment groove 49 for supporting and positioning the reinforcing pipe 18 (not shown).

Figure 11A:
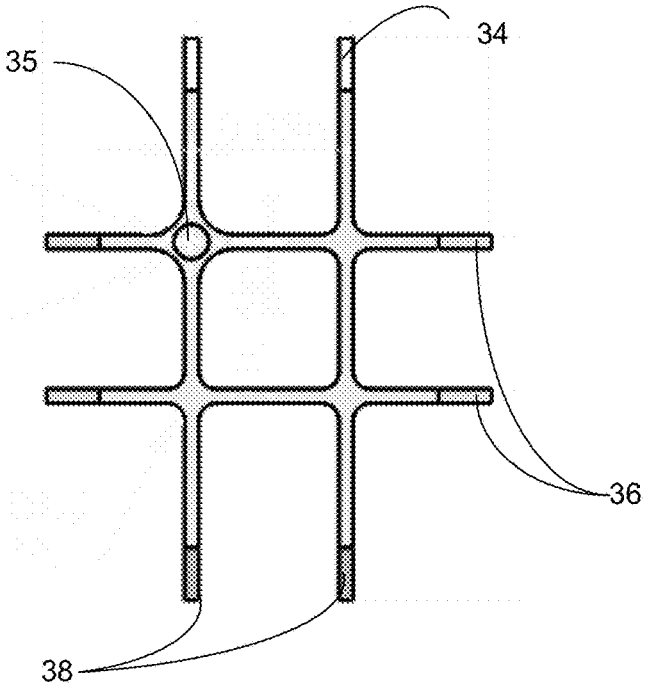
FIGS. 11A and 11B are perspective views of an alternative embodiment of the supportive insert shown in FIG. 4.
Figure 11B:
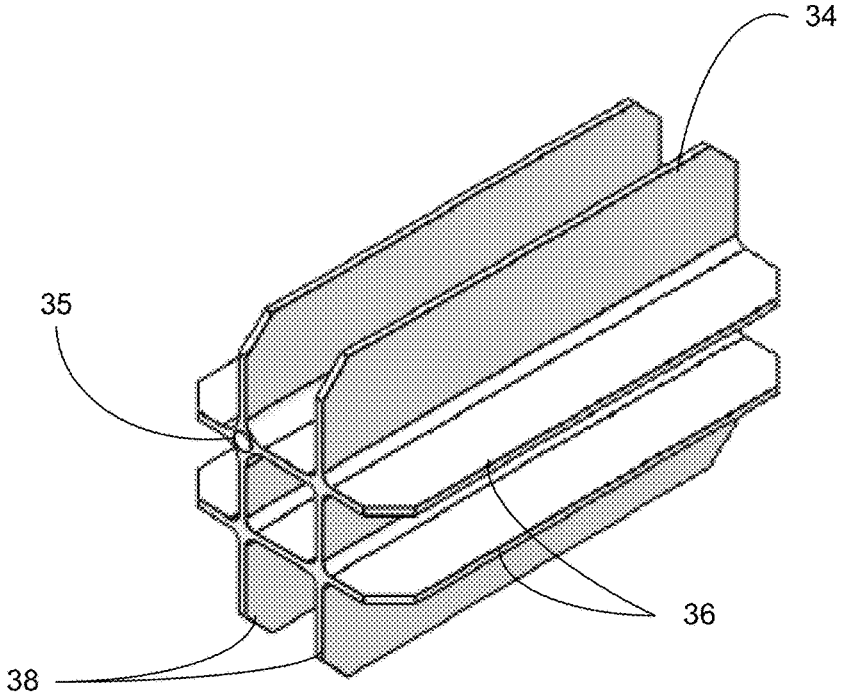

According to further alternative preferred embodiments, as shown in FIGS. 11A and 11B, the structural inserts 34 may include one or more integral housings 35 for securing a reinforcing pipe 39 (or other reinforcing materials) within the body of the structural insert 34. According to alternative embodiments, the integral housing(s) 35 may be formed into one or more of the horizontally extending walls 36 or vertically extending walls 38. According to further preferred embodiments, the integral housing 35 may preferably be formed near or within a point of intersection of a horizontally extending wall 36 and a vertically extending wall 38.

Figure 5:
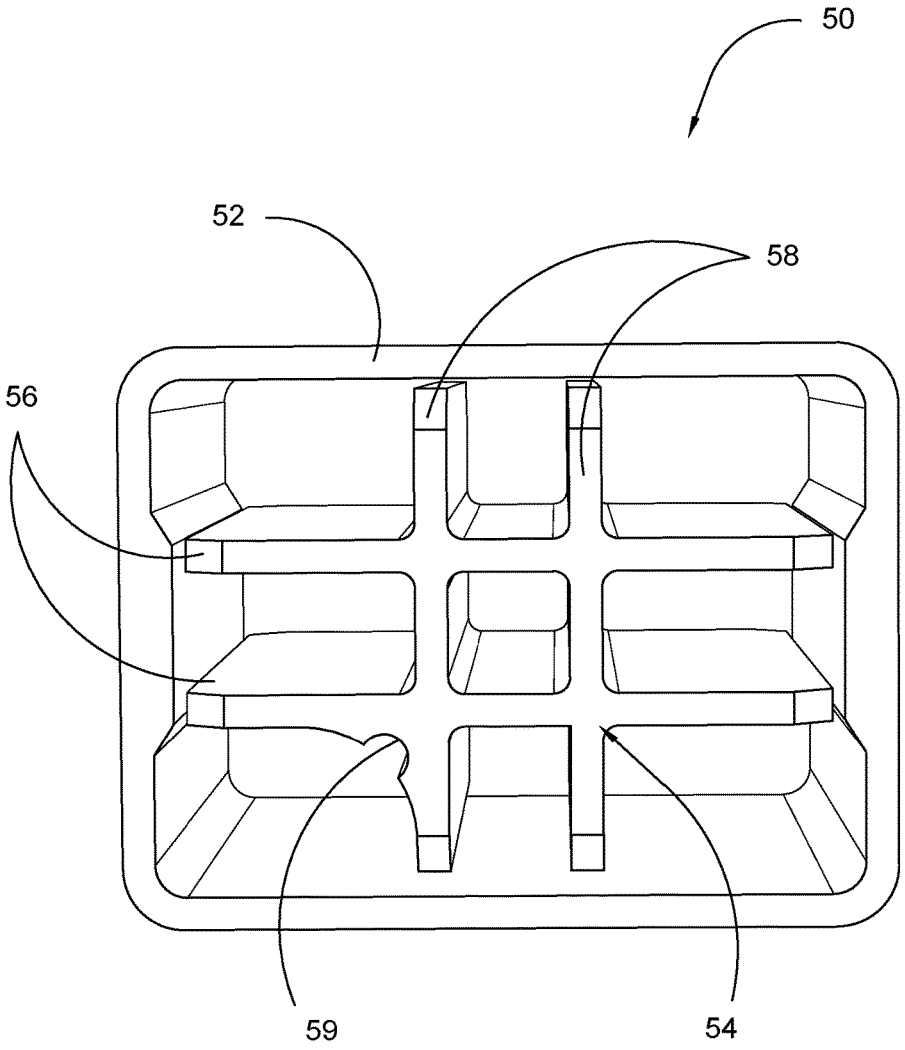
FIG. 5 is a side view of a preferred alternative embodiment of the present invention.

With reference now to FIG. 5, a second side view of an exemplary cross arm 50 built in accordance with the present invention shall now be further discussed. As shown in FIG. 5, the exemplary cross arm 50 preferably includes an outer wall 52 surrounding an inserted structure 54 which includes a pair of vertical walls 58 which intersect with horizontal walls 56. As further shown, the inserted structure 54 preferably further includes an alignment groove 59 for supporting and positioning the reinforcing pipe 18. As shown, the thickness of the walls 56 and 58 of the internal structure 54 is greater than the thickness of the walls 46 and 48 shown in FIG. 4. According to further aspects of the present invention, the thickness and positioning of the individual walls may be further tailored and adjusted for the specific loads and composite materials of each specific cross arm.

Figure 6:
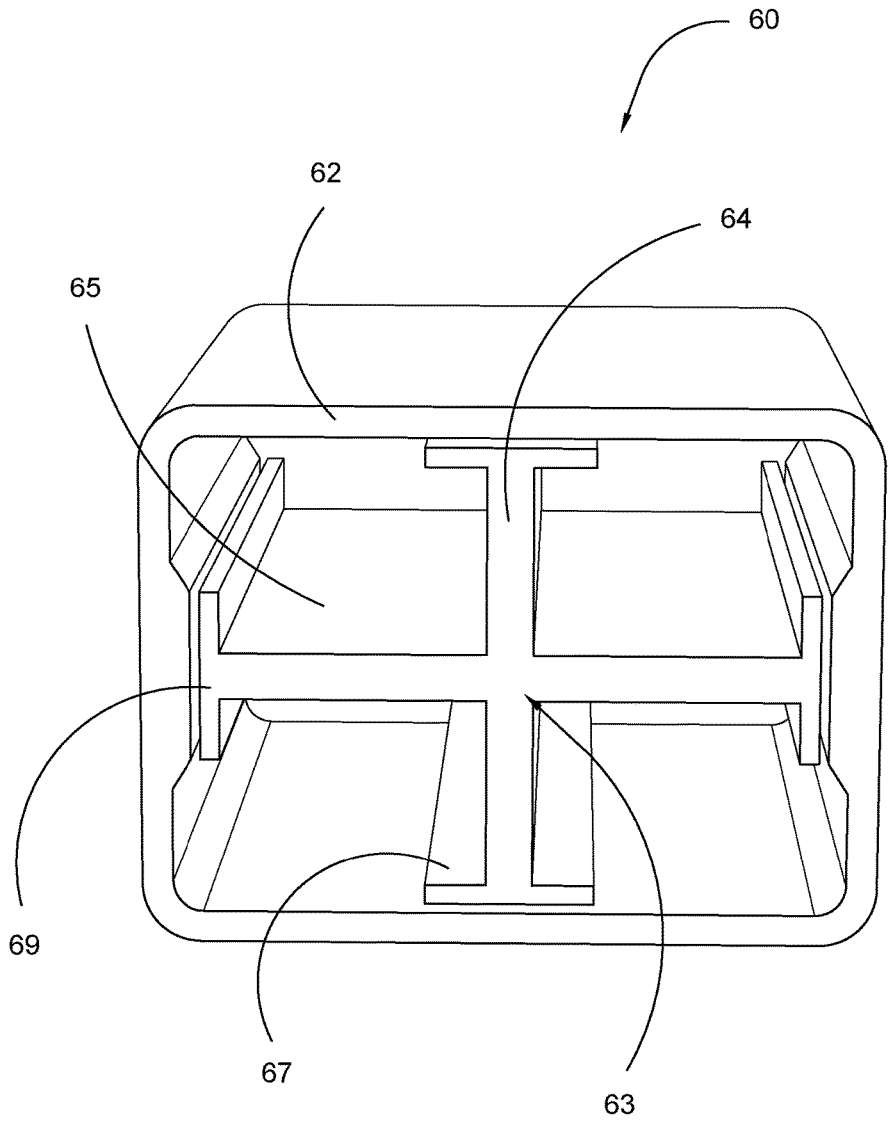
FIG. 6 is side view of a further preferred alternative embodiment of the present invention.

With reference now to FIG. 6, a side view of a further exemplary cross arm 60 built in accordance with an alternative embodiment of the present invention shall now be discussed. As shown in FIG. 6, an exemplary cross arm 60 preferably includes an outer wall 62 surrounding an inserted structure 63 which includes a single vertical wall 64 which intersects with horizontal wall 65. As further shown, the horizontal wall 65 preferably further includes a vertical mounting surface 69 on both ends. Likewise, the vertical wall 64 preferably further includes a horizontal mounting surface 67 on each end.

Figure 7:
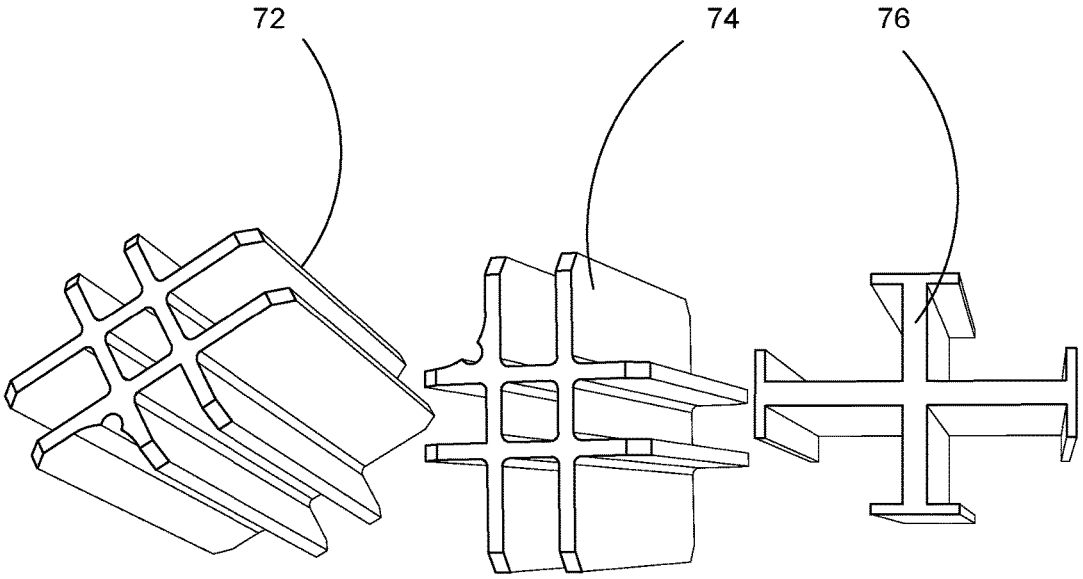
FIG. 7 provides examples of supportive inserts for use with the present invention.

With reference now to FIG. 7, exemplary inserts 72, 74 and 76 are shown prior to insertion within a cross arm. These inserts shown are purely illustrative and further alternative structures are contemplated in accordance with the present invention. According to still further embodiments of the present invention, each insert may preferably be encapsulated and/or filled with urethane foam (or the like) either before or after being positioned within a cross arm section. Still further, the lengths of each inserted structure may preferably be 6" or longer and may be spaced throughout the interior of an embodying cross arm.

As shown in the table below, the results of incorporating the present invention within cross arm structures are surprising and significant. As shown, by using the present invention, the maximum torque usable with a single cross arm section is increased by a factor of 3 to 15 times through the use of a small inserted section.

TABLE 1

| Strength Test | | | | |
|---|---|---|---|---|
| STYLE | Torque Maximum (ft./lbs.) | Torque Initial Crack (ft./lbs.) | J-Type Pin Cantilever Load (lbs) | COMMENTS |
| Thin Tic Tac Toe | 130 | 100 | 950 | No damage to the arm in the pin load test |
| Thick Tick Tac Toe | 350 | 100 | 1080 | No damage to the arm in the pin load test |
| Single Post Type | 100 | 60 | 950 | No damage to the arm in the pin load test |
| Without Insert | 25 | 20 | 600 | Damage to the arm at 600# caused by digging into the top of the laminate |

Figure 8:
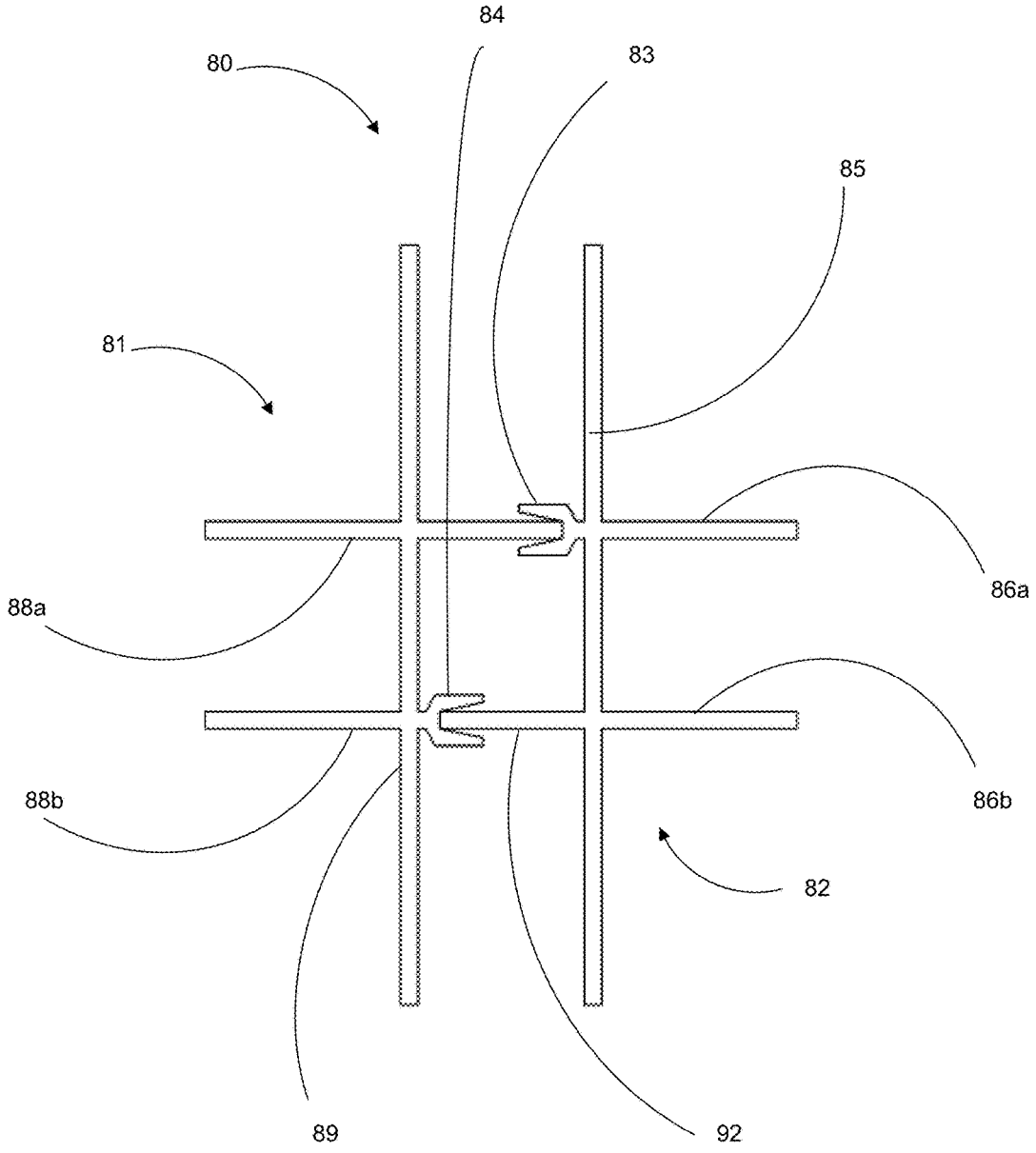
FIG. 8 is a first view at elevation of a further alternative embodiment of a supportive insert in accordance with the present invention.
Figure 9:
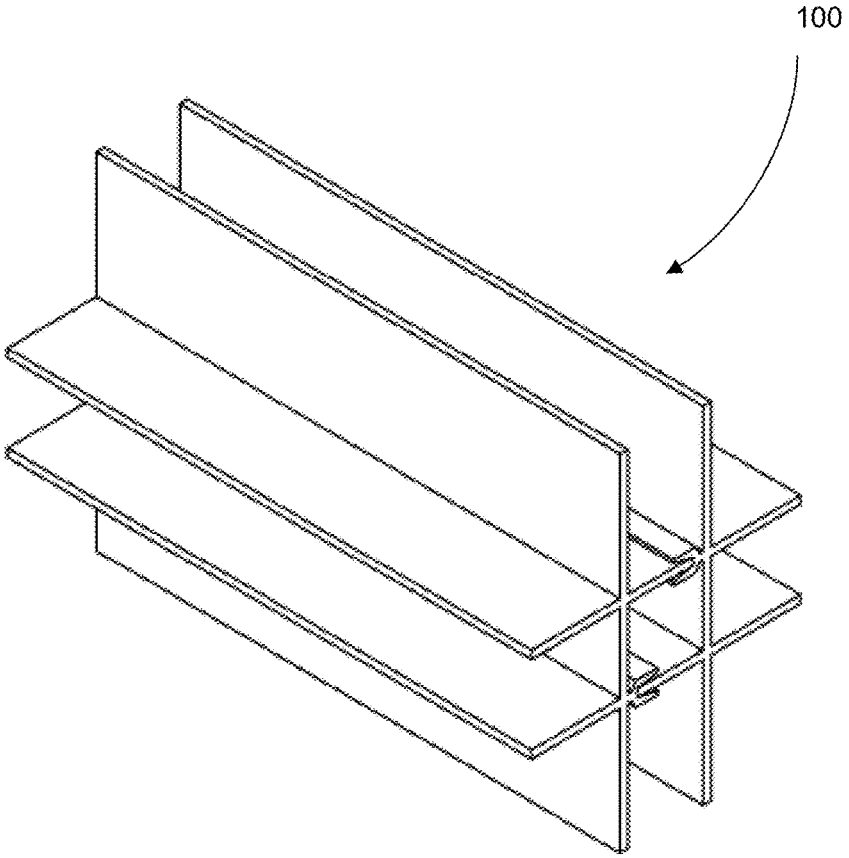
FIG. 9 is a perspective view of the embodiment illustrated in FIG. 8.

Referring now to FIG. 8, a further aspect of the present invention shall now be further discussed. As shown in FIG. 8, an exemplary structural insert 80 may be formed from a pair of interlocking sections 81 and 82 which are connected at locking points 83 and 84. Accordingly, as shown, a first interlocking section 81 may preferably include a vertical section 89 and horizontal sections 88*a* and 88*b*. As further shown, a second interlocking section 82 may include vertical section 85 and horizontal sections 86*a* and 86*b*. FIG. 9 provides a further perspective view of the structural insert 100 formed from the interlocking sections illustrated in FIG. 8.

Figure 10:
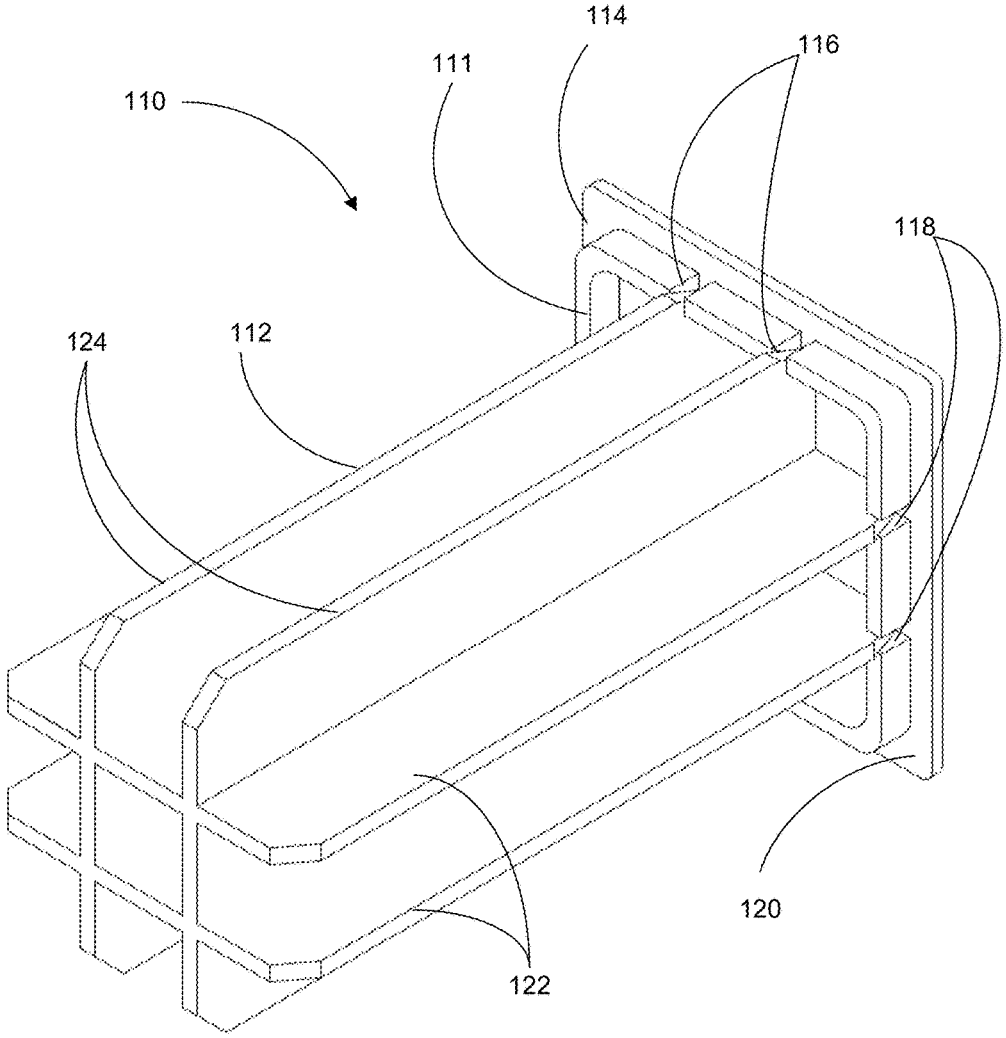
FIG. 10 is a perspective view of an alternative preferred embodiment of the present invention including a supportive insert and a slotted end-cap.

FIG. 10 is a perspective view 110 of an alternative preferred embodiment of the present invention including a supportive structural insert 112 and a slotted end-cap 114. As shown, the slotted end-cap 114 may preferably include a raised wall 111 which is preferably sized to create a frictional seal with an outer wall (not shown) of an enclosing cross arm structure. As further shown, the slotted end-cap 114 may preferably further include vertical slots 116 for receiving and enclosing vertical sections 124 of the structural insert 112. Additionally, the slotted end-cap 114 may preferably further include horizontal slots 118 for receiving and enclosing horizontal sections 122 of the structural insert 112.

According to alternative preferred embodiments, the slotted end-cap 114 of the present invention may alternatively be fitted for attachment to one or more ends of a given pole or cross arm. According to alternative preferred embodiments, the slotted end-cap 114 may be integrally formed with the structural insert 34. Alternatively, the end cap 31 may be formed separately and attached after the structural insert 34 is formed.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. A supporting structure for supporting an outer wall of a pole, the supporting structure comprising:

a first horizontally extending wall;

a second horizontally extending wall; wherein the first horizontally extending wall is parallel to the second horizontally extending wall;

a third vertically extending wall;

a fourth vertically extending wall; wherein the third vertically extending wall is parallel to the fourth vertically extending wall;

further wherein the third vertically extending wall is perpendicular to the first and second horizontally extending walls;

a reinforcing pipe; and an alignment groove; wherein the alignment groove is comprised of a substantially semi-circular groove which is formed adjacent to a point of intersection between the first horizontally extending wall and the third vertically extending wall;

wherein the reinforcing pipe is secured within the alignment groove.

2. A supporting structure for supporting an outer wall of a pole, the supporting structure comprising:

a first horizontally extending wall;

a second horizontally extending wall; wherein the first horizontally extending wall is parallel to the second horizontally extending wall;

a third vertically extending wall;

a fourth vertically extending wall; wherein the third vertically extending wall is parallel to the fourth vertically extending wall;

further wherein the third vertically extending wall is perpendicular to the first and second horizontally extending walls;

a reinforcing pipe; and an alignment groove; wherein the alignment groove is comprised of a substantially semi-circular groove which is formed adjacent to a point of intersection between the first horizontally extending wall and the fourth vertically extending wall.

3. A supporting structure for supporting an outer wall of a pole, the supporting structure comprising:

a first horizontally extending wall;

a second horizontally extending wall; wherein the first horizontally extending wall is parallel to the second horizontally extending wall;

a third vertically extending wall;

a fourth vertically extending wall; wherein the third vertically extending wall is parallel to the fourth vertically extending wall;

further wherein the third vertically extending wall is perpendicular to the first and second horizontally extending walls;

a reinforcing pipe; and an alignment groove; wherein the alignment groove is comprised of a substantially semi-circular groove which is formed adjacent to a point of intersection between the second horizontally extending wall and the third vertically extending wall.

4. A supporting structure for supporting an outer wall of a pole, the supporting structure comprising:

a first horizontally extending wall;

a second horizontally extending wall; wherein the first horizontally extending wall is parallel to the second horizontally extending wall;

a third vertically extending wall;

a fourth vertically extending wall; wherein the third vertically extending wall is parallel to the fourth vertically extending wall;

further wherein the third vertically extending wall is perpendicular to the first and second horizontally extending walls;

a reinforcing pipe; and an alignment groove; wherein the alignment groove is comprised of a substantially semi-circular groove which is formed adjacent to a point of intersection between the second horizontally extending wall and the fourth vertically extending wall.

5. The supporting structure of claim 1, wherein the first horizontal wall is comprised of a first wall section and a second wall section; further wherein the second horizontal wall is comprised of a third wall section and a fourth wall section; wherein the first wall section and the third wall section are integrally formed with the first vertical wall to form a first integral wall portion; further wherein the second wall section and the fourth wall section are integrally formed with the second vertical wall to form a second integral wall portion.

6. The supporting structure of claim 5, wherein the first integral wall portion and the second integral wall portion are configured to connect.

7. The supporting structure of claim 6, wherein the first integral wall portion and the second integral wall portion are configured to connect at a first locking point and a second locking point; wherein the first locking point is integrally formed within the first horizontal wall; further wherein the second locking point is integrally formed within the second horizontal wall.

8. The supporting structure of claim 4, wherein the cross arm structure further comprises a slotted end-cap.

9. The supporting structure of claim 8, wherein the slotted end-cap is further comprised of:

a raised wall, wherein the raised wall is sized to create a frictional seal within the outer wall of the pole.

10. The supporting structure of claim 9, wherein the slotted end-cap is further comprised of:

a plurality of horizontal slots for receiving the first and second horizontally extending walls; and a plurality of vertical slots for receiving the third and fourth vertically extending walls.

* * * * *